US011064757B1

(12) United States Patent
Huggins

(10) Patent No.: US 11,064,757 B1
(45) Date of Patent: Jul. 20, 2021

(54) WEATHERPROOF PROTECTIVE GEAR FOR CYCLING

(71) Applicant: Robert Huggins, Chicago, IL (US)

(72) Inventor: Robert Huggins, Chicago, IL (US)

( * ) Notice: Subject to any disclaimer, the term of this patent is extended or adjusted under 35 U.S.C. 154(b) by 0 days.

(21) Appl. No.: 17/182,019

(22) Filed: Feb. 22, 2021

Related U.S. Application Data

(60) Provisional application No. 63/090,023, filed on Oct. 9, 2020.

(51) Int. Cl.
*A42B 3/28* (2006.01)
*A42B 3/22* (2006.01)
*A42B 3/30* (2006.01)

(52) U.S. Cl.
CPC ..... *A42B 3/288* (2013.01); *A42B 3/225* (2013.01); *A42B 3/306* (2013.01)

(58) Field of Classification Search
CPC .. A42B 3/24; A42B 3/225; A42B 3/28; A42B 3/283; A42B 3/286; A42B 3/288; A42B 3/306
See application file for complete search history.

(56) References Cited

U.S. PATENT DOCUMENTS

| | | | | |
|---|---|---|---|---|
| 6,425,143 | B1 * | 7/2002 | Benedict | A42B 3/24 2/171.3 |
| 2014/0123373 | A1 * | 5/2014 | Harriman | A42B 3/24 2/424 |
| 2014/0345627 | A1 * | 11/2014 | Younts | A42B 3/24 128/861 |
| 2019/0029356 | A1 * | 1/2019 | Michel | A42C 5/04 |
| 2020/0229530 | A1 * | 7/2020 | Feher | A42B 3/286 |

* cited by examiner

*Primary Examiner* — Katherine M Moran

(57) ABSTRACT

A weatherproof protective gear for cycling is an apparatus which keeps the user refreshed, the upper body dry, and facilitates breathing in different weather conditions. The apparatus may include a full-head helmet, a face shield, a length-adjustable collar, a sleeveless torso shroud, a portable airflow system, and an exhaust snorkel. The full-head helmet protects the user's head while also facilitating airflow around the head from the portable airflow system. The face shield protects the user's face from the environment and facilitates vision in most weather conditions. The length-adjustable collar hermetically connects the full-head helmet to the sleeveless torso shroud to maintain a sealed environment. The sleeveless torso shroud protects the chest and the user's back from the environment and maintains the upper torso refreshed by the portable airflow system. Finally, the exhaust snorkel allows the user to breathe while wearing the present invention.

16 Claims, 9 Drawing Sheets

WEATHERPROOF PROTECTIVE GEAR FOR CYCLING

The current application claims a priority to the U.S. Provisional Patent application Ser. No. 63/090,023 filed on Oct. 9, 2020.

FIELD OF THE INVENTION

The present invention generally relates to cycling accessories and apparel. More specifically, the present invention provides a weatherproof apparatus for cyclists that facilitates breathing in all weather conditions.

BACKGROUND OF THE INVENTION

Bicycle touring or tour cycling is one of the most accessible ways to have an outdoors adventure throughout the country. Bicycle touring can be spontaneous and does not require much planning since bicycle touring just involves going to a new place, exploring the surroundings for long enough to unwind, and coming home refreshed. Bicycle touring cross country means tent city, no comfort of home for recuperation. Bicycle touring can be planned with loved ones to spend quality time together and can last for different periods of time at different intervals. Unfortunately, the planned journey can be affected by harsh weather conditions which can hamper and spoil the adventure tour. Available apparel such as rain jacket hoodies or sauna suits protect against harsh weather conditions to a certain extent, but not completely. However, these apparatuses do not provide complete waterproofing and air-cooling solutions inside the apparel, nor protect the face of the user. In addition, the available apparel such as the body suits for harsh weather can be uncomfortable in all day rain and sunshine, or on again off again weather conditions.

For example, a rain jacket hoodie tied tightly may prevent the chest front from getting wet, but a slight amount of water may still seep through the areas left unintentionally loose near the neck, leaving the neck area damp. Further, the seepage may reach the chest and dampen the chest area, making the user cover lesser distance than planned due to the uneasiness and unconformity. Further, the user can get sick if proper precautions are not taken into consideration. The sauna suit can help overcome some of these issues to a large extent, but the suit traps a considerable amount of heat near the chest area, making the user feel uneasy or uncomfortable. Also, the sauna suit does not provide any face protection from rain, snow, dust, etc, increasing the chances of accidents. The user may choose to ride with the head down but that multiplies the chances of accidents. Therefore, there is a need for improved waterproof apparatuses for a bicyclist that overcome these problems and/or limitations.

An objective of the present invention is to provide a weatherproof protective gear for cycling that can be worn while touring on a bicycle, taking trip for pleasure, or travelling for an adventure. The present invention helps users to overcome harsh weather conditions by eliminating the hurdles which the user might face while riding the bicycle on such conditions. For example, the present invention keeps the upper body of the user dry during rain, snow, etc. and keeps the body refreshed. In addition, the present invention protects the face of the user and maintains a clear vision for the user to monitor the road and the surroundings. Further, the present invention can easily be worn along with other cycling gear, such as over a sauna suit top garment generally worn while bicycling, which makes the present invention even more comfortable to wear while still providing protection to the user. Furthermore, the present invention can be manufactured at a fraction of the cost of currently available body suits or similar apparel.

SUMMARY OF THE INVENTION

According to some embodiments, the present invention provides a weatherproof protective gear for cycling. The present invention, also referred to as the Turtle Suit, facilitates the breathing of the user in any weather condition while fully protecting the face and the head of the user from the different weather conditions. The combination of the full-head helmet with a face shield and an exhaust snorkel helps protect the face and the head of the user while permitting the user to exhale out of the full-head helmet, thus avoiding condensation from building up inside. The present invention further provides a system that facilitates airflow to the upper body of the user to keep the user cool and refreshed. The length-adjustable collar also enables the present invention to the head and the neck of the user comfortably.

In addition, the present invention provides a sleeveless torso shroud to protect the upper torso of the user. The sleeveless torso shroud may include a front flap and a rear flap that covers the chest area and back area of the user. The front flap and the rear flap can be fastened using multiple magnetic fasteners to secure the sleeveless torso shroud to the body of the user. Further, the rear flap is longer than the front flap to protect the user from any back splash in rainy weather. The sleeveless torso shroud can also be connected to the airflow system to maintain the chest and back areas fresh. Furthermore, the sleeveless torso shroud can support different accessories such as an air pump for a portable airflow system, a "smart" pocket to hold a wireless electronic device, such as a smartphone. Further features and benefits are discussed in the sections below.

DETAILED DESCRIPTION OF THE INVENTION

All illustrations of the drawings are for the purpose of describing selected versions of the present invention and are not intended to limit the scope of the present invention.

Figure 1:
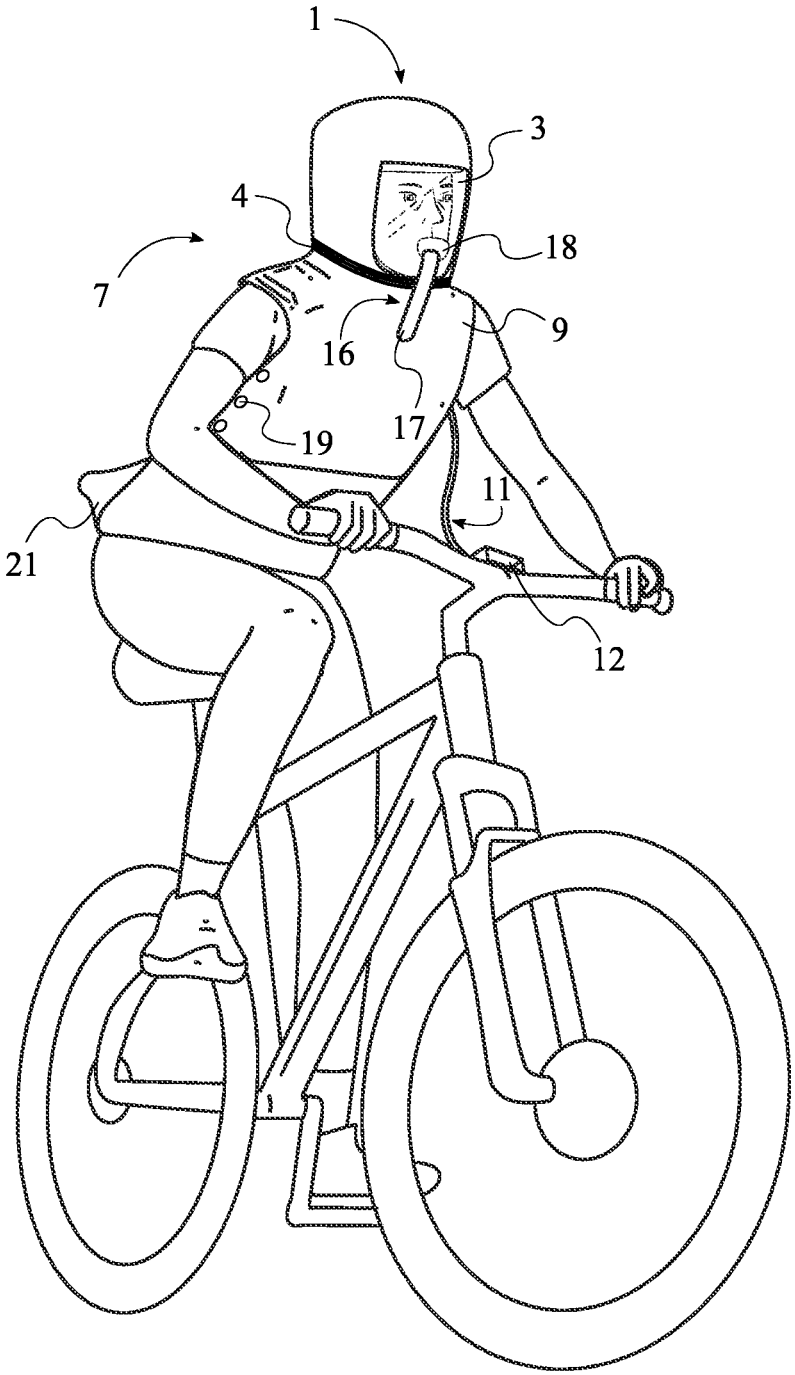
FIG. 1 is a top-front-right perspective view showing the present invention, wherein the present invention is shown worn by a person riding a bicycle.
Figure 2:
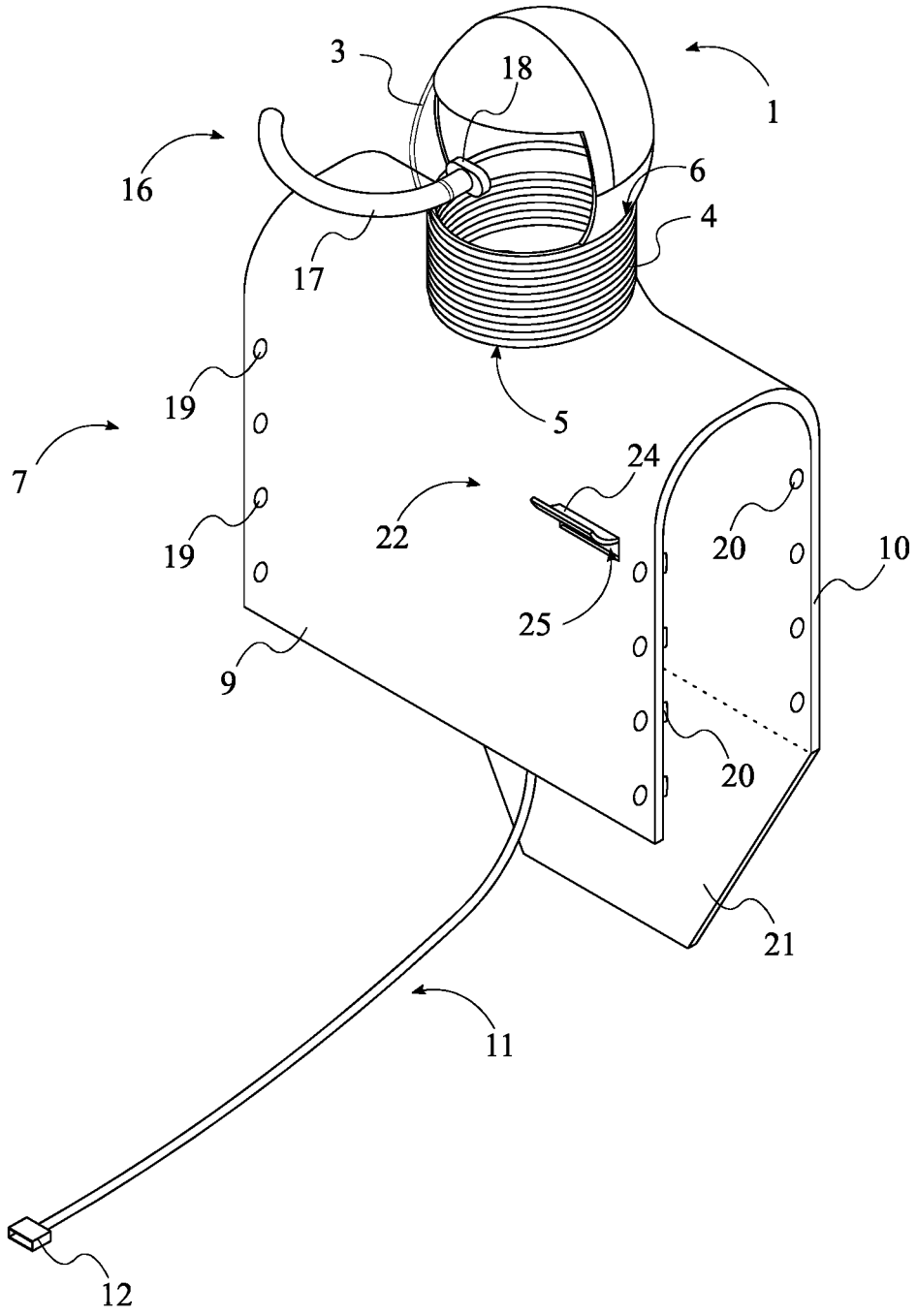
FIG. 2 is a top-front-left perspective view showing the present invention, wherein the present invention is shown in a fully assembled configuration.
Figure 3:
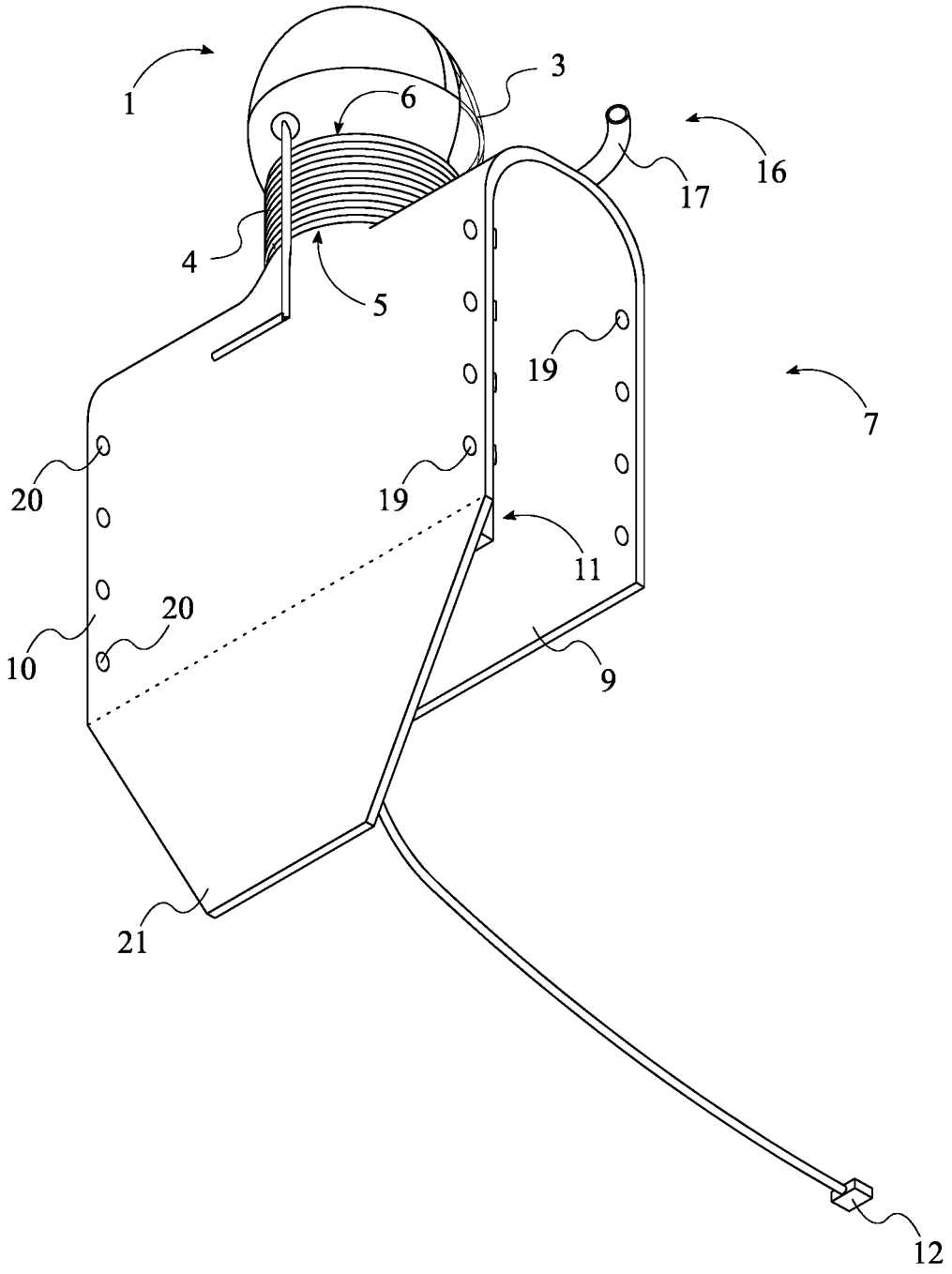
FIG. 3 is a rear-bottom-right perspective view showing the present invention.

The present invention is a weatherproof protective gear for cycling which keeps the user refreshed, the upper body dry, and facilitates breathing in different weather conditions. As can be seen in FIG. 1 through 3, the present invention, also referred to as the Turtle Suit, may comprise a full-head helmet 1, a face shield 3, a length-adjustable collar 4, a sleeveless torso shroud 7, a portable airflow system 11, and an exhaust snorkel 16. The full-head helmet 1 provides protection to the head of the user while also facilitating internal airflow generated from the portable airflow system 11. The face shield 3 protects the face of the user from the environment and facilitates better visibility in most weather conditions. The length-adjustable collar 4 maintains a sealed environment for the user's neck between the head helmet 1 and the sleeveless torso shroud 7. The sleeveless torso shroud 7 covers the chest and the back of the user from the environment and maintains the upper torso refreshed with the airflow generated by the portable airflow system 11. Further, the sleeveless torso shroud 7 is designed to not interfere with the legs. Finally, the exhaust snorkel 16 allows the user to inhale and exhale air from outside the confines of the present invention so that the face shield 3 does not fog up while the present invention is in use.

Figure 4:
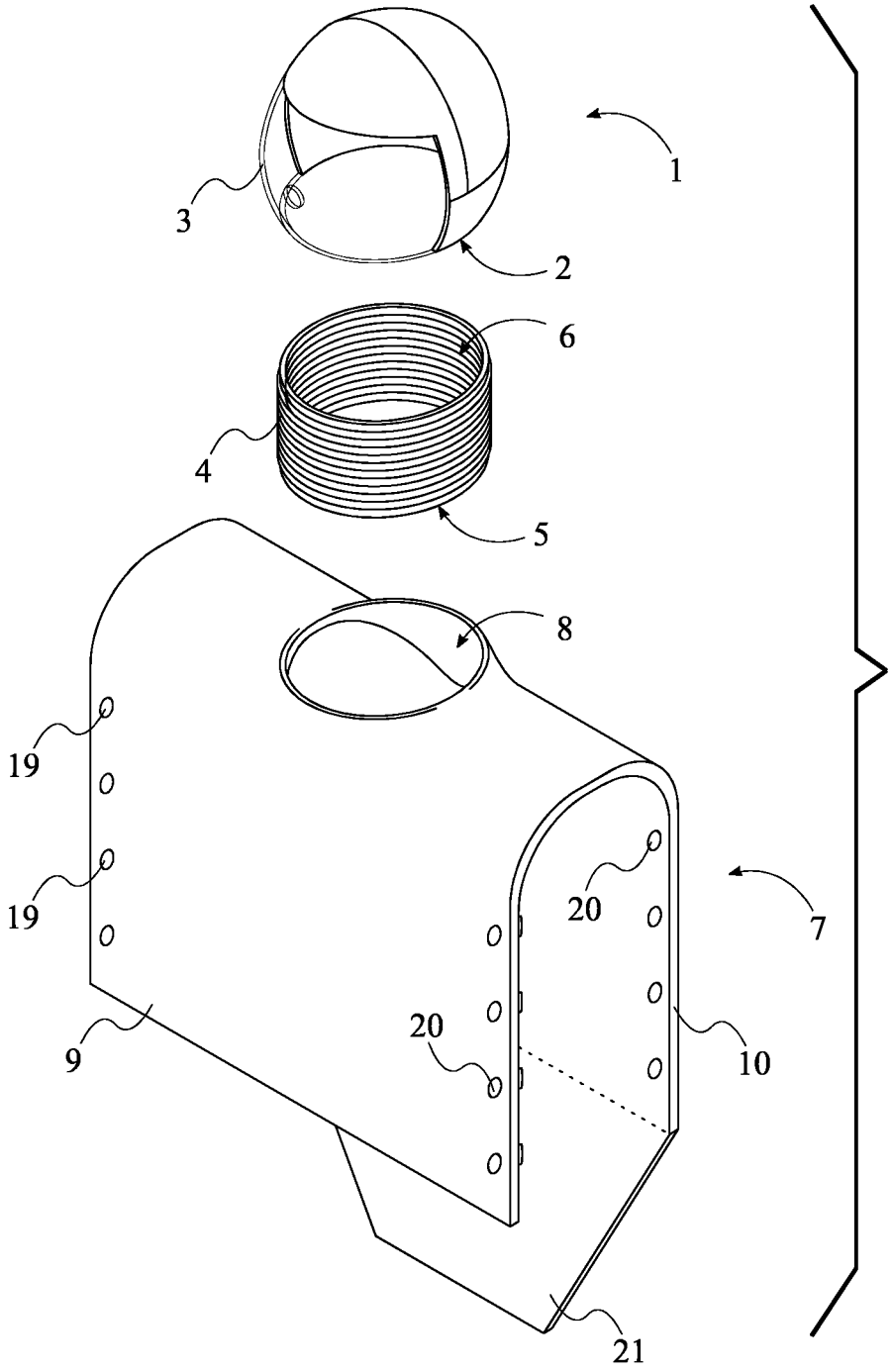
FIG. 4 is a top-front-left exploded perspective view showing the present invention without the exhaust snorkel, the portable airflow system, nor the weatherproof pocket.
Figure 5:
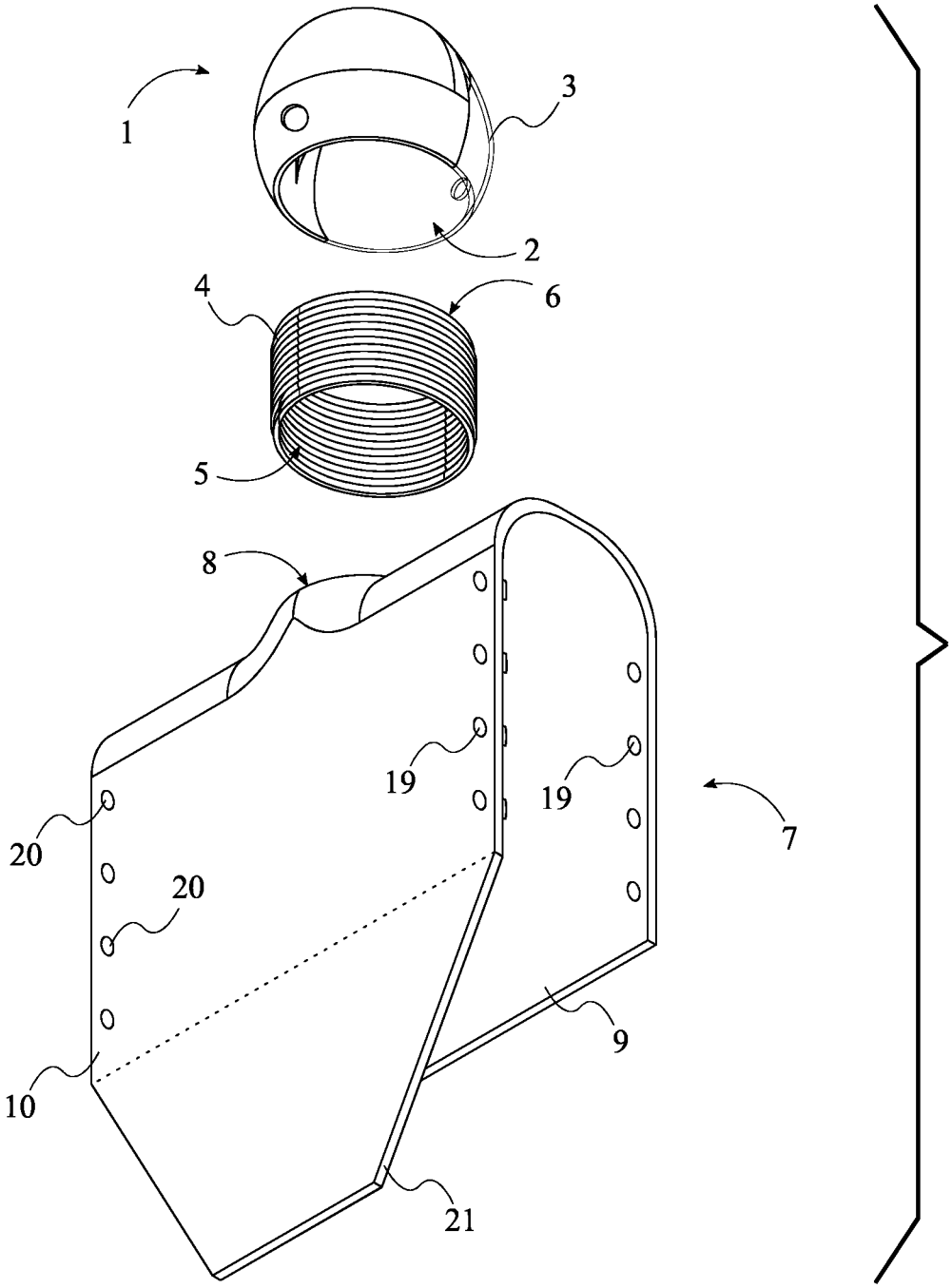
FIG. 5 is a rear-bottom-right exploded perspective view showing the present invention without the exhaust snorkel, the portable airflow system, nor the weatherproof pocket. shortened
Figure 7:
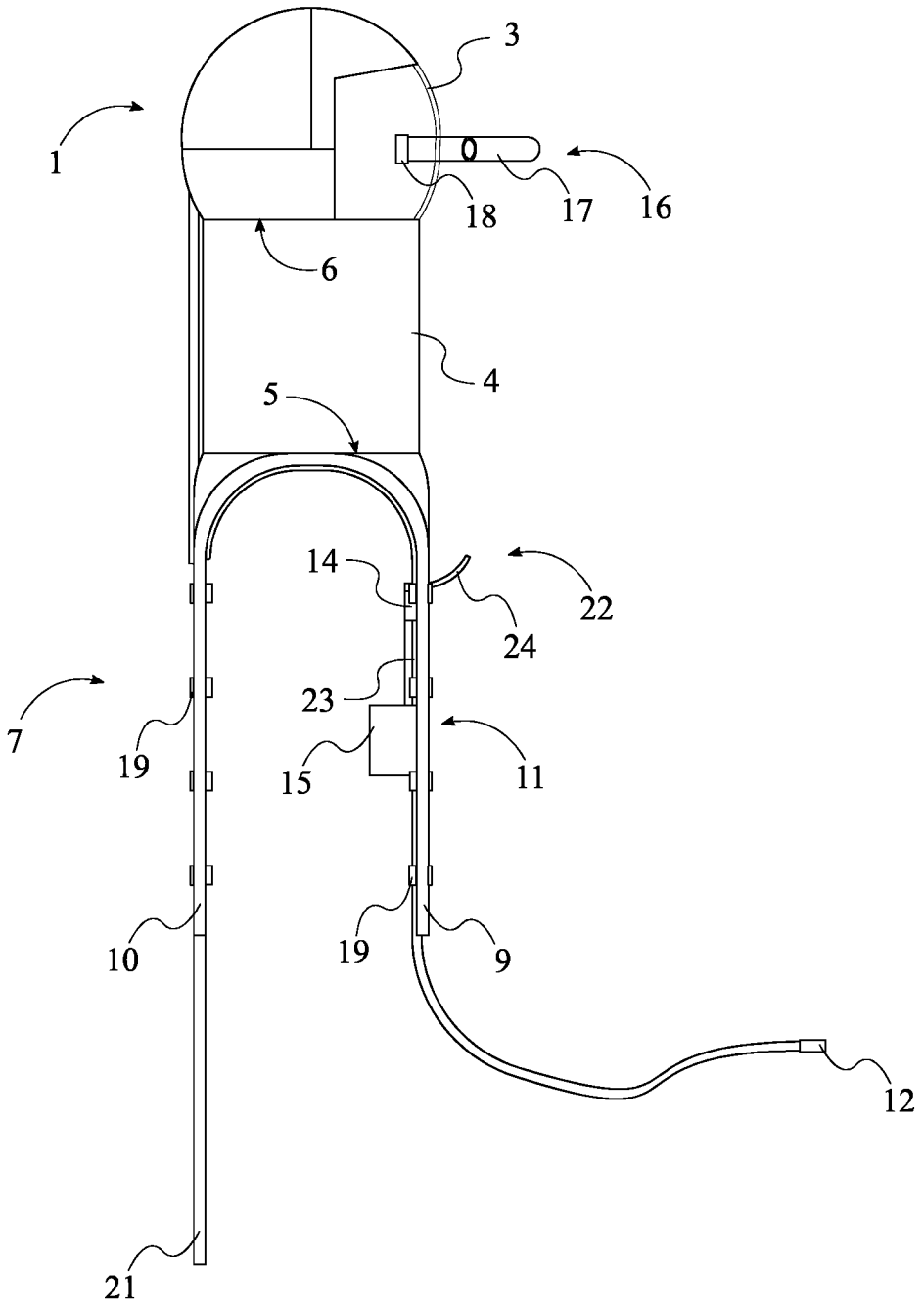
FIG. 7 is a side view of the present invention, wherein the length-adjustable collar is shown in an expanded configuration.
Figure 8:
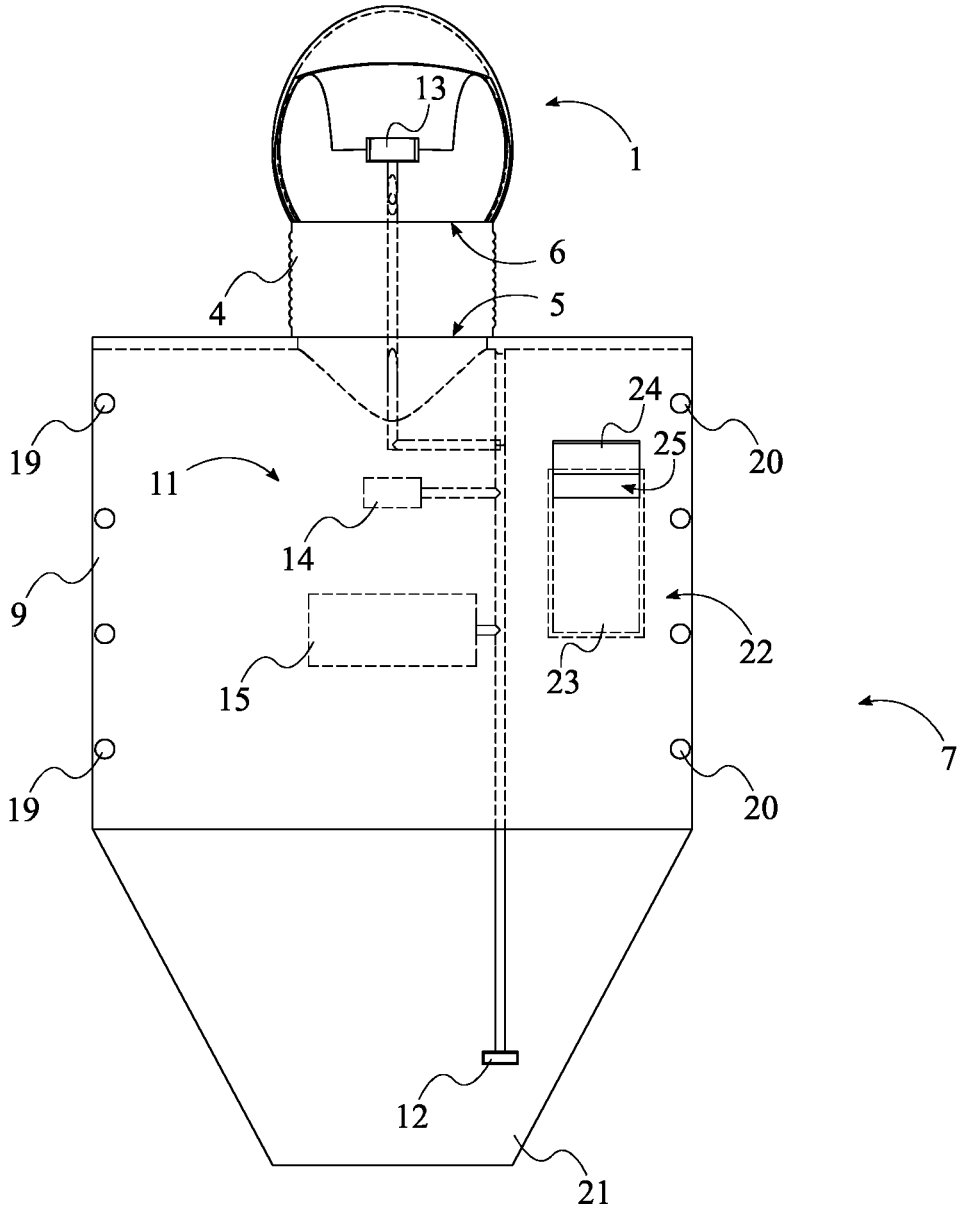
FIG. 8 is a schematic front view of the present invention showing the different components of the portable airflow system, wherein the exhaust snorkel and the face shield are not shown.

The general configuration of the aforementioned components allows the user wearing the present invention to comfortably and securely ride a bicycle for any period of time or distance in various weather conditions. As can be seen in FIGS. 4 and 5, the length-adjustable collar 4 comprises a proximal open end 5 and a distal open end 6 to be connected to the full-head helmet 1 and to the sleeveless torso shroud 7, respectively. As can be seen in FIGS. 1, 7, and 8, the portable airflow comprises a clip-on vent 12, a helmet outlet 13, and a shroud outlet 14 to enable airflow from the surroundings into the full-head helmet 1 and the sleeveless torso shroud 7. The face shield 3 is integrated into the full-head helmet 1 to form a single structure worn on the head of the user. The full-head helmet 1 is preferably designed to cover the cranium of the user and may comprise a helmet fastening mechanism that enables the full-head helmet 1 to be secured to the head of the user. The helmet fastening mechanism can be a traditional strap mechanism that is length adjustable and can be fastened under the chin to prevent the full-head helmet 1 from moving around the head. However, other helmet fastening mechanisms can be used according to the overall design of the present invention. In addition, the full-head helmet 1 is made from materials such as, but not limited to, fiberglass, carbon fiber, polycarbonate plastic, Kevlar, etc. Further, soft padding may be mounted within the full-head helmet 1. Furthermore, the full-head helmet 1 may include a face shield 3. The face shield 3 is preferably made from transparent, shatterproof material shaped to conform to the shape of the face of the user. Like the helmet fastening mechanism, the face shield 3 can include different styles according to the overall design of the present invention. For example, in some embodiments, the face shield 3 may include an outer anti-glare layer, a polarized layer, a hydrophobic coating, or a combination thereof to further improve the vision of the user. In other embodiments, the face shield 3 may be hingedly connected to the full-head helmet 1 so that the user may selectively open or close the full-head helmet 1 as desired.

Figure 6:
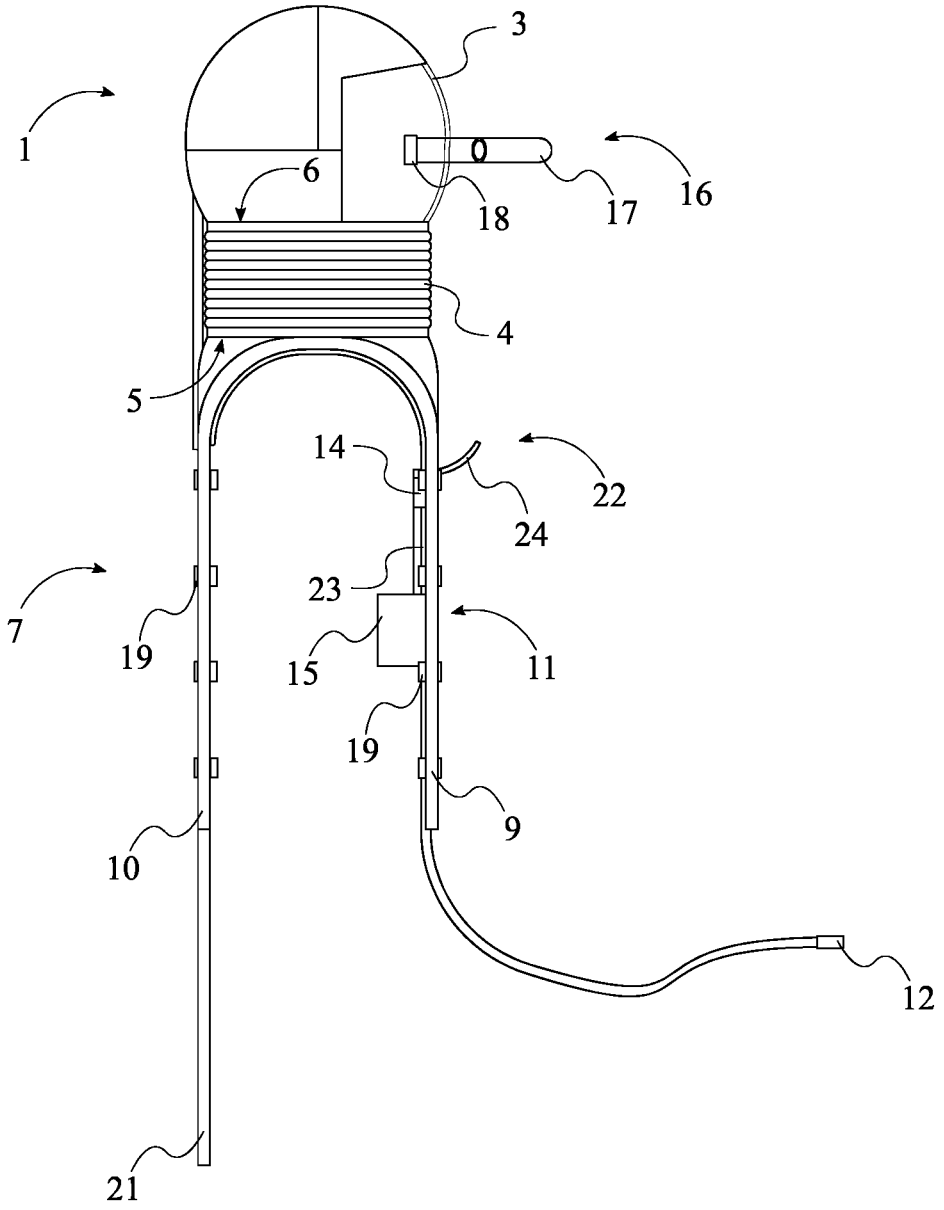

In addition, a head-receiving opening 2 of the full-head helmet 1 is hermetically connected around the proximal open end 5 to prevent air leaks under the chin of the user. As can be seen in FIGS. 1, 3, and 4, the head-receiving opening 2 corresponds to the opening through where the user would insert their head when putting on the full-head helmet 1. Likewise, a neck-receiving opening 8 of the sleeveless torso shroud 7 is hermetically connected around the proximal open end 5 to prevent air leaks around the neck of the user. As a result, the full-head helmet 1 and the length-adjustable collar 4 are sealed from the surroundings to prevent rain, wind, or dust from getting into the present invention. In addition, the length-adjustable collar 4 is preferably designed as an accordion-like tubular structure that can be expanded or contracted to accommodate the length and the movement by the user's neck, as can be seen in FIGS. 6 and 7. Furthermore, the clip-on vent 12 is externally positioned to the sleeveless torso shroud 7 and is also positioned offset from the sleeveless torso shroud 7 to enable the inflow of air from the surroundings into the portable airflow system 11, as can be seen in FIGS. 1 and 2. This arrangement also allows the clip-on vent 12 to act as a cold-air intake for present invention. The clip-on vent 12 preferably comprises an attachment mechanism that enables the user to attach the clip-on vent 12 to any external structure such as the frame of the bicycle, preferably on the bicycle fork for greater airflow due to the movement of the bicycle. In some embodiments, the clip-on vent 12 may be selectively opened or closed so that the user may control the airflow through the portable airflow system 11, thus controlling the airflow within the present invention.

Moreover, the helmet outlet 13 is mounted within the full-head helmet 1 to enable airflow into the full-head helmet 1. As can be seen in FIG. 8, the helmet outlet 13 is preferably designed to guide the air inflow throughout the full-head helmet 1, mostly concentrated about the user's face. Likewise, the shroud outlet 14 is mounted within the sleeveless torso shroud 7 to enable airflow into the sleeveless torso shroud 7. The shroud outlet 14 is preferably positioned adjacent to the chest area. However, one or more secondary shroud outlets may be positioned adjacent to other torso areas, such as the back. The clip-on vent 12 is in fluid communication with the helmet outlet 13 and the shroud outlet 14 to create an airflow from the surroundings into the present invention. Thus, the head, the chest, and the back of the user are kept fresh by the airflow generated by the movement of the bicycle. Finally, the exhaust snorkel 16 is hermetically attached through the face shield 3 to facilitate the breathing of the user while wearing the present invention. As can be seen in FIGS. 1 and 2, the exhaust snorkel 16 enables the exhaled air to be expelled out of the full-head helmet 1 to maintain a fresh environment inside and to prevent the face shield 3 from fogging up. The exhaust snorkel 16 may also enable breathing in through the mouth, if necessary.

To facilitate either exhaling or inhaling through the mouth, the exhaust snorkel 16 comprises a breathing tube 17 and a mouthpiece 18. As can be seen in FIGS. 1, 2, and 6, the breathing tube 17 traverses through the face shield 3 to enable airflow through the face shield 3. The breathing tube 17 is also oriented away from the face shield 3 to prevent blocking the view of the user through the face shield 3. The mouthpiece 18 is positioned within the full-head helmet 1 and adjacent to the user's mouth for easy access to the mouthpiece 18. Finally, the mouthpiece 18 is terminally and hermetically connected to the breathing tube 17 so no air leaks into the full-head helmet 1. A tube filter may be integrated into the external opening of the breathing tube 17 to prevent impurities from flowing into the breathing tube 17. Thus, the user may safely breathe through the breathing tube 17 if necessary.

In case not enough airflow is generated by the motion of the bicycle, the portable airflow system 11 may further comprise an air pump 15. As can be seen in FIG. 8, the air pump 15 is preferably small enough to be carried on the present invention. The air pump 15 is preferably battery powered and rechargeable so the air pump 15 can be utilized for long periods. The air pump 15 is mounted within the sleeveless torso shroud 7 so that the air pump 15 is protected from the environment. In addition, the air pump 15 is in fluid communication with the clip-on vent 12, the helmet outlet 13, and the shroud outlet 14 to increase the airflow from the clip-on vent 12 to the helmet outlet 13 and the shroud outlet 14. The air pump 15 can include an integrated power switch so the user can selectively activate or deactivate the air pump 15. Furthermore, the air pump 15 may comprise an integrated heat-exchanger and filtration mechanism to generate cooled and filtrated airflow flowing into the full-head helmet 1 and the sleeveless torso shroud 7.

The sleeveless torso shroud 7 is preferably designed to be easily put on by the user. As can be seen in FIG. 1 through 3, the sleeveless torso shroud 7 may further comprise a front flap 9 and a rear flap 10. The front flap 9 and the rear flap 10 are both elongated pieces of flat material large enough to cover at least the chest and back areas of the user. In addition, the front flap 9 is positioned opposite to the rear flap 10 about the sleeveless torso shroud 7, leaving free space under the arms for greater comfort to the user when wearing the present invention. In addition, to secure the front flap 9 and the rear flap 10 to the body of the user, the present invention may further comprise at least one first magnetic fastener 19 and at least one second magnetic fastener 20. The at least one first magnetic fastener 19 is used to attach one side of the front flap 9 and the rear flap 10 together, while the at least second magnetic fastener 20 is used to attach the other side of the of front flap 9 and the rear flap 10 together. The front flap 9 and the rear flap 10 are preferably made from waterproof material and the outer surfaces may be coated with high-visibility colors. The at least one first magnetic fastener 19 is positioned opposite to the at least one second magnetic fastener 20 about the sleeveless torso shroud 7 to fasten both sides of the sleeveless torso shroud 7. The at least one first magnetic fastener 19 and the at least one second magnetic fastener 20 is positioned offset from the length-adjustable collar 4 to reduce the movement of the front flap 9 and the rear flap 10. The at least one first magnetic fastener 19 is connected in between the front flap 9 and the rear flap 10. Likewise, the at least one second magnetic fastener 20 is connected in between the front flap 9 and the rear flap 10. Thus, the front flap 9 and the rear flap 10 are secured around the user's torso. In some embodiments, the at least one first magnetic fastener 19 and the at least one second magnetic fastener 20 may each be length adjustable so that the sleeveless torso shroud 7 may be adjusted to fit the body of the user. The at least one first magnetic fastener 19 and the at least one second magnetic fastener 20 can each also comprise a first magnetic fastener section and a second magnetic fastener section that can be connected to each other using a male/female buckle assembly. Furthermore, the at least one first magnetic fastener 19 and the at least one second magnetic fastener 20 can each be multiple first magnetic fasteners and multiple second magnetic fasteners, respectively. The multiple first magnetic fasteners and the multiple second magnetic fasteners may be respectively distributed along the sides of the sleeveless torso shroud 7 to fully secure the front flap 9 to the rear flap 10 against the body of the user.

In addition to the at least one first magnetic fastener 19 and the at least one second magnetic fastener 20, the present invention may further comprise a flap extension 21 designed to cover the rear of the user when cycling. As can be seen in FIGS. 6 and 7, the flap extension 21 is terminally connected to the rear flap 10, opposite to the length-adjustable collar 4, to extend the overall length of the rear flap 10. As a result, the flap extension 21 covers the user's derriere when seated on the bicycle and prevents water and other debris from hitting the user's derriere due to the rotation of the rear wheel of the bicycle. In other embodiments, additional protection can be provided on the rear flap, adjacent to the bottom of the user, for greater protection and comfort to the user while riding the bicycle for long periods of time.

To enable the user to carry delicate instruments and devices while riding the bicycle, the present invention may further comprise a weatherproof pocket 22, where the devices can be stored at and be protected from the weather. As can be seen in FIGS. 2 and 8, the weatherproof pocket 22 comprises a pocket body 23 big enough to store the desired items and a pocket closure 24 designed to seal the pocket body 23 and fully protect the stored items. The pocket body 23 is externally mounted onto the sleeveless torso shroud 7 so the user can easily access the pocket from outside the sleeveless torso shroud 7. The pocket closure 24 is hingedly connected to the sleeveless torso shroud 7 so that the user can selectively open or close the pocket body 23. In addition, the pocket closure 24 is positioned adjacent to a pocket opening 25 of the pocket body 23 to fully cover the pocket opening 25, thus covering the pocket body 23 and the items stored within from any weather condition. In other embodiments, the weatherproof pocket 22 can be multiple weatherproof pockets distributed about the sleeveless torso shroud 7 and each designed to store different items.

Figure 9:
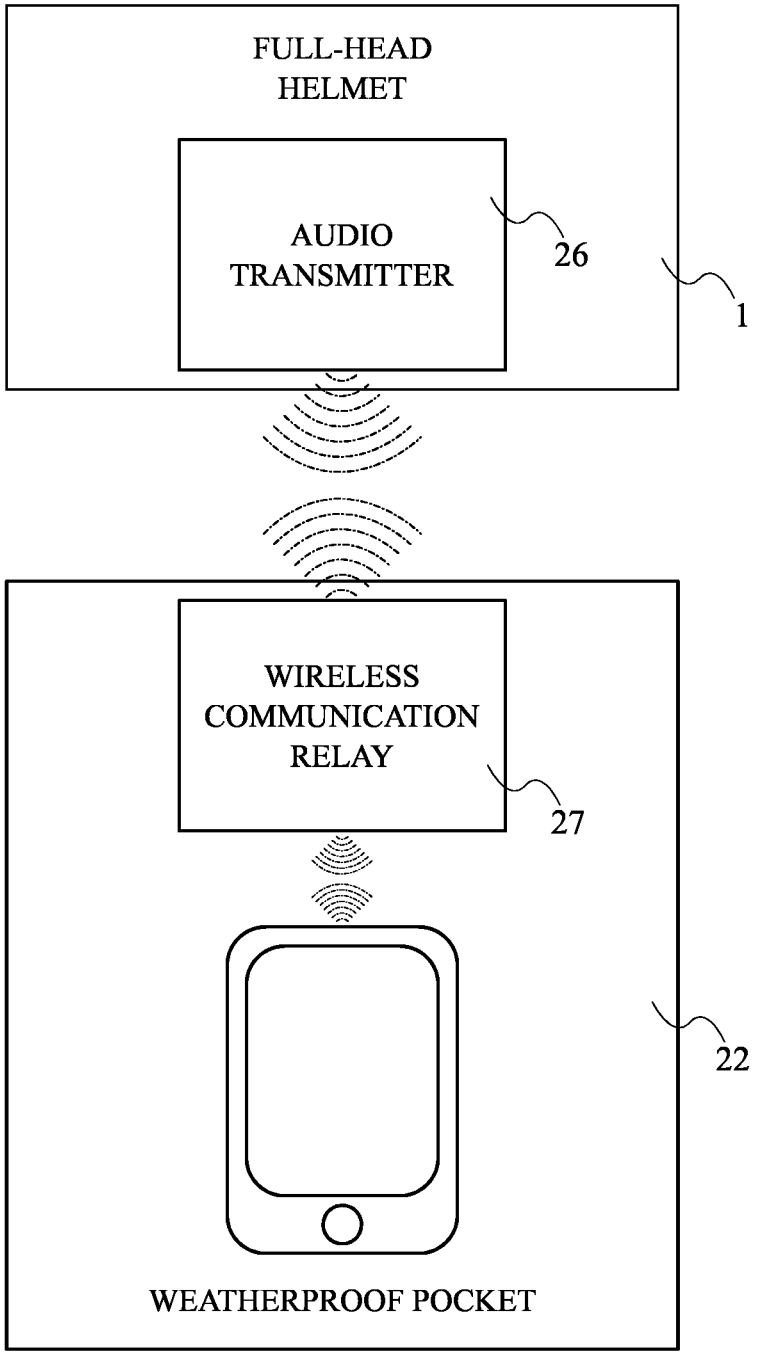
FIG. 9 is a schematic diagram showing the audio transmitter and the wireless communication relay of the present invention.

Finally, to enable the user to utilize different electronic devices while riding the bicycle in any weather condition, the present invention may further comprise an audio transmitter 26 and a wireless communication relay 27. As can be seen in FIG. 9, the wireless communication relay 27 is positioned within the weatherproof pocket 22 so that an electronic device stored within the pocket body 23 may be communicably coupled to the wireless communication relay 27. For example, a smartphone stored within the pocket body 23 can be wirelessly connected to the wireless communication relay 27 using available wireless communication technologies, such as Bluetooth or Near Field Communication (NFC). On the other hand, the audio transmitter 26 is mounted within the full-head helmet 1 to send or receive audio signals. The audio transmitter 26 is also communicably coupled to the wireless communication relay 27. Thus, audio signals can be transmitted to/from the audio transmitter 26 from/to the electronic device being stored within the weatherproof pocket 22. For example, the audio transmitter 26 can be electronically connected to a microphone and at least one speaker mounted within the full-head helmet 1 to enable the user make calls, send audio messages, or send voice commands to a smartphone stored within the weatherproof pocket 22. In addition, the user may also control the operation of the air pump 15 via the audio transmitter 26 and the wireless communication relay 27. The air pump 15 may be electronically connected to the wireless communication relay 27 to receive command signals from the paired electronic device so that the user may selectively power the air pump 15. Likewise, a pivoting closure of the clip-on vent 12 may be also electronically connected to the wireless communication relay 27 to receive command signals from the paired electronic device so that the user may selectively open or close the clip-on vent 12. Other electronic devices may also be paired with the wireless communication relay 27 so that the user can voice control the electronic devices via the audio transmitter 26.

Although the invention has been explained in relation to its preferred embodiment, it is to be understood that many other possible modifications and variations can be made without departing from the spirit and scope of the invention as hereinafter claimed.

What is claimed is:

1. A weatherproof protective gear for cycling comprising:
a full-head helmet;
a face shield;
a length-adjustable collar;
a sleeveless torso shroud;
a portable airflow system;
an exhaust snorkel;
the length-adjustable collar comprising a proximal open end and a distal open end;
the portable airflow system comprising a clip-on vent, a helmet outlet, and a shroud outlet;
the face shield being integrated into the full-head helmet;
a head-receiving opening of the full-head helmet being hermetically connected around the distal open end;
a neck-receiving opening of the sleeveless torso shroud being hermetically connected around the proximal open end;
the clip-on vent being externally positioned to the sleeveless torso shroud;
the clip-on vent being positioned offset from the sleeveless torso shroud;
the helmet outlet being mounted within the full-head helmet;
the shroud outlet being mounted within the sleeveless torso shroud;
the clip-on vent being in fluid communication with the helmet outlet and the shroud outlet; and,
the exhaust snorkel being hermetically attached through the face shield.

2. The weatherproof protective gear for cycling as claimed in claim 1 comprising:
the exhaust snorkel comprising a breathing tube and a mouthpiece;
the breathing tube traversing through the face shield;
the mouthpiece being positioned within the full-head helmet; and,
the mouthpiece being terminally and hermetically connected to the breathing tube.

3. The weatherproof protective gear for cycling as claimed in claim 1 comprising:
the portable airflow system further comprising an air pump;
the air pump being mounted within the sleeveless torso shroud; and,
the air pump being in fluid communication with the clip-on vent, the helmet outlet, and the shroud outlet.

4. The weatherproof protective gear for cycling as claimed in claim 1 comprising:
the sleeveless torso shroud comprising a front flap and a rear flap; and,
the front flap being positioned opposite to the rear flap about the sleeveless torso shroud.

5. The weatherproof protective gear for cycling as claimed in claim 4 comprising:
at least one first magnetic fastener;
at least one second magnetic fastener;
the at least one first magnetic fastener being positioned opposite to the at least one second magnetic fastener about the sleeveless torso shroud;
the at least one first magnetic fastener and the at least one second magnetic fastener being positioned offset from the length-adjustable collar;
the at least one first magnetic fastener being connected in between the front flap and the rear flap; and,
the at least one second magnetic fastener being connected in between the front flap and the rear flap.

6. The weatherproof protective gear for cycling as claimed in claim 4 comprising:
a flap extension; and,
the flap extension being terminally connected to the rear flap, opposite to the length-adjustable collar.

7. The weatherproof protective gear for cycling as claimed in claim 1 comprising:
a weatherproof pocket;
the weatherproof pocket comprising a pocket body and a pocket closure;
the pocket body being externally mounted onto the sleeveless torso shroud;
the pocket closure being hingedly connected to the sleeveless torso shroud; and,
the pocket closure being positioned adjacent to a pocket opening of the pocket body.

8. The weatherproof protective gear for cycling as claimed in claim 7 comprising:
an audio transmitter;
a wireless communication relay;
the wireless communication relay being positioned within the weatherproof pocket;
the audio transmitter being mounted within the full-head helmet; and,
the audio transmitter being communicably coupled to the wireless communication relay.

9. A weatherproof protective gear for cycling comprising:
a full-head helmet;
a face shield;
a length-adjustable collar;
a sleeveless torso shroud;
a portable airflow system;
an exhaust snorkel;
the length-adjustable collar comprising a proximal open end and a distal open end;
the portable airflow system comprising a clip-on vent, a helmet outlet, and a shroud outlet;
the exhaust snorkel comprising a breathing tube and a mouthpiece;
the face shield being integrated into the full-head helmet;
a head-receiving opening of the full-head helmet being hermetically connected around the distal open end;
a neck-receiving opening of the sleeveless torso shroud being hermetically connected around the proximal open end;
the clip-on vent being externally positioned to the sleeveless torso shroud;
the clip-on vent being positioned offset from the sleeveless torso shroud;
the helmet outlet being mounted within the full-head helmet;
the shroud outlet being mounted within the sleeveless torso shroud;
the clip-on vent being in fluid communication with the helmet outlet and the shroud outlet;

the exhaust snorkel being hermetically attached through the face shield;

the breathing tube traversing through the face shield;

the mouthpiece being positioned within the full-head helmet; and, the mouthpiece being terminally and hermetically connected to the breathing tube.

10. The weatherproof protective gear for cycling as claimed in claim 9 comprising:

the portable airflow system further comprising an air pump;

the air pump being mounted within the sleeveless torso shroud; and, the air pump being in fluid communication with the clip-on inlet, the helmet outlet, and the shroud outlet.

11. The weatherproof protective gear for cycling as claimed in claim 9 comprising:

at least one first magnetic fastener;

at least one second magnetic fastener;

the sleeveless torso shroud comprising a front flap and a rear flap;

the front flap being positioned opposite to the rear flap about the sleeveless torso shroud;

the at least one first magnetic fastener being positioned opposite to the at least one second magnetic fastener about the sleeveless torso shroud;

the at least one first magnetic fastener and the at least one second magnetic fastener being positioned offset from the length-adjustable collar;

the at least one first magnetic fastener being connected in between the front flap and the rear flap; and, the at least one second magnetic fastener being connected in between the front flap and the rear flap.

12. The weatherproof protective gear for cycling as claimed in claim 11 comprising:

a flap extension; and, the flap extension being terminally connected to the rear flap, opposite to the length-adjustable collar.

13. The weatherproof protective gear for cycling as claimed in claim 9 comprising:

a weatherproof pocket;

an audio transmitter;

a wireless communication relay;

the weatherproof pocket comprising a pocket body and a pocket closure;

the pocket body being externally mounted onto the sleeveless torso shroud;

the pocket closure being hingedly connected to the sleeveless torso shroud;

the pocket closure being positioned adjacent to a pocket opening of the pocket body;

the wireless communication relay being positioned within the weatherproof pocket;

the audio transmitter being mounted within the full-head helmet; and, the audio transmitter being communicably coupled to the wireless communication relay.

14. A weatherproof protective gear for cycling comprising:

a full-head helmet;

a face shield;

a length-adjustable collar;

a sleeveless torso shroud;

a portable airflow system;

an exhaust snorkel;

the length-adjustable collar comprising a proximal open end and a distal open end;

the portable airflow system comprising a clip-on vent, a helmet outlet, a shroud outlet, and an air pump;

the exhaust snorkel comprising a breathing tube and a mouthpiece;

the face shield being integrated into the full-head helmet;

a head-receiving opening of the full-head helmet being hermetically connected around the distal open end;

a neck-receiving opening of the sleeveless torso shroud being hermetically connected around the proximal open end;

the clip-on vent being externally positioned to the sleeveless torso shroud;

the clip-on vent being positioned offset from the sleeveless torso shroud;

the helmet outlet being mounted within the full-head helmet;

the shroud outlet being mounted within the sleeveless torso shroud;

the clip-on vent being in fluid communication with the helmet outlet and the shroud outlet;

the exhaust snorkel being hermetically attached through the face shield;

the breathing tube traversing through the face shield;

the mouthpiece being positioned within the full-head helmet;

the mouthpiece being terminally and hermetically connected to the breathing tube;

the air pump being mounted within the sleeveless torso shroud; and, the air pump being in fluid communication with the clip-on inlet, the helmet outlet, and the shroud outlet.

15. The weatherproof protective gear for cycling as claimed in claim 14 comprising:

at least one first magnetic fastener;

at least one second magnetic fastener;

a flap extension;

the sleeveless torso shroud comprising a front flap and a rear flap;

the front flap being positioned opposite to the rear flap about the sleeveless torso shroud;

the at least one first magnetic fastener being positioned opposite to the at least one second magnetic fastener about the sleeveless torso shroud;

the at least one first magnetic fastener and the at least one second magnetic fastener being positioned offset from the length-adjustable collar;

the at least one first magnetic fastener being connected in between the front flap and the rear flap;

the at least one second magnetic fastener being connected in between the front flap and the rear flap; and, the flap extension being terminally connected to the rear flap, opposite to the length-adjustable collar.

16. The weatherproof protective gear for cycling as claimed in claim 14 comprising:

a weatherproof pocket;

an audio transmitter;

a wireless communication relay;

the weatherproof pocket comprising a pocket body and a pocket closure;

the pocket body being externally mounted onto the sleeveless torso shroud;

the pocket closure being hingedly connected to the sleeveless torso shroud;

the pocket closure being positioned adjacent to a pocket opening of the pocket body;

the wireless communication relay being positioned within the weatherproof pocket; and, the audio transmitter being mounted within the full-head helmet;

the audio transmitter being communicably coupled to the wireless communication relay.

* * * * *